US006222159B1

(12) United States Patent
Healy

(10) Patent No.: US 6,222,159 B1
(45) Date of Patent: Apr. 24, 2001

(54) WARMER FOR BASEBALL BATS

(76) Inventor: James S. Healy, 14999 Wonderlich Rd., No. 108, Houston, TX (US) 77069

( * ) Notice: Subject to any disclaimer, the term of this patent is extended or adjusted under 35 U.S.C. 154(b) by 0 days.

(21) Appl. No.: 09/589,413

(22) Filed: Jun. 7, 2000

(51) Int. Cl.[7] ..... F24C 3/00; F24H 3/00
(52) U.S. Cl. ..... 219/386; 206/315.1; 312/236
(58) Field of Search ..... 219/385, 386, 219/394, 428; 126/226–231; 312/236; 206/315.1, 315.6

(56) References Cited

U.S. PATENT DOCUMENTS 3,707,279 * 12/1972 Kaiser ..... 206/315.6
3,800,863 * 4/1974 Bauman, Jr. ..... 165/47
4,418,930 * 12/1983 Ryan, Jr. ..... 280/47.19
5,062,528 * 11/1991 Whitaker, Jr. ..... 206/315.6
5,341,927 * 8/1994 Coyner ..... 206/315.6
5,687,705 11/1997 Blair .
5,786,574 7/1998 Garnett .
5,834,738 * 11/1998 Wilson ..... 219/386
5,975,293 * 11/1999 Fowler ..... 206/315.1

* cited by examiner

*Primary Examiner*—Joseph Pelham
(74) *Attorney, Agent, or Firm*—Rankin, Hill, Porter & Clark LLP

(57) ABSTRACT

A multiple cavity, portable baseball or softball bat warmer consisting of an insulated case with capped, suspended, open ended tubes adapted to receive bats in a vertical position that are connected to a heat chamber. The bat barrels are retained on a height-adjusting grate that is positioned according to league level. A convection thermal heat source is positioned below the retaining grate. Warmed air from the heat source rises through the grate heating the bats retained in the capped cavities above.

15 Claims, 9 Drawing Sheets

WARMER FOR BASEBALL BATS

BACKGROUND OF THE INVENTION

1. Field of the Invention

The present invention relates to a device for warming baseball or softball bats above ambient temperature.

2. Brief Description of the Prior Art

Since 1839 when baseball was invented and 1887 when softball was invented, it has always been known that it is difficult to bat in cold weather. This is true, in general, because there is a reduction in the elasticity of the bat and ball as temperatures decrease. In addition, the ball does not travel as far in dense cold air.

Aluminum bats were introduced for amateur baseball play in 1970 to reduce operating costs caused by wooden bat breakage. Operating costs have been reduced with aluminum bat usage in all playing conditions except one. If the game is played in temperatures below 60° F., aluminum bats have a tendency to dent and crack. Since high-end, thin-walled aluminum bats retail for more than $250 each, the cost of supporting a team can increase significantly in cold weather.

During the past five years, there has been an effort to improve aluminum bat performance in cold weather and further reduce operating costs. Most of the innovations have attempted to solve the problem by providing a blanket or sleeve to cover individual bats prior to being placed in service by the batter.

By way of example, U.S. Pat. No. 5,786,574 to Garnett discloses a cylindrical insulated sleeve that uses a battery to supply DC current to a heating wire to warm the hitting portion of a baseball bat. U.S. Pat. No. 5,687,705 to Blair discloses an aluminum baseball or softball bat warmer that uses a convective heat source below a bat chamber separated from an outer container by an air space to warm a single bat.

While these devices fulfill their respective, particular objectives, the present invention substantially departs from the conventional concepts and designs of the prior art, and in doing so provides an apparatus primarily developed for the purpose of providing a means to heat multiple bats in a single container for amateur baseball and softball team play.

SUMMARY OF THE INVENTION

In view of the above, it is an objective of the present invention to provide a means of warming multiple baseball or softball bats in a single device to improve bat performance while reducing the likelihood of bat damage. Other objects and features of the invention will be in part apparent and in part pointed out hereinafter.

In accordance with the invention, a warmer for baseball or softball bats has an insulated, elongated, exterior container with a closed bottom and a top with a series of circular holes. A heat chamber is formed at the bottom of the exterior container by a retainer that connects open-ended, vertical tubes through the holes in the top. Bats placed inside these tubes extend beyond the bottom of the tubes and are retained by a height adjusting retaining grate that is positioned according to the level of league play. After the bats are in position, caps are placed on the top end of the tubes to seal the bats in place. A convective heat source is positioned in the heat chamber. In use, warmed air from the convective source rises through the retaining grate warming the bat barrels in the heat chamber as well as the bat handles positioned in the tubes.

The invention summarized above comprises the construction hereinafter described, the scope of the invention being indicated by the subjoined claims.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DETAILED DESCRIPTION OF THE INVENTION

Figure 1:
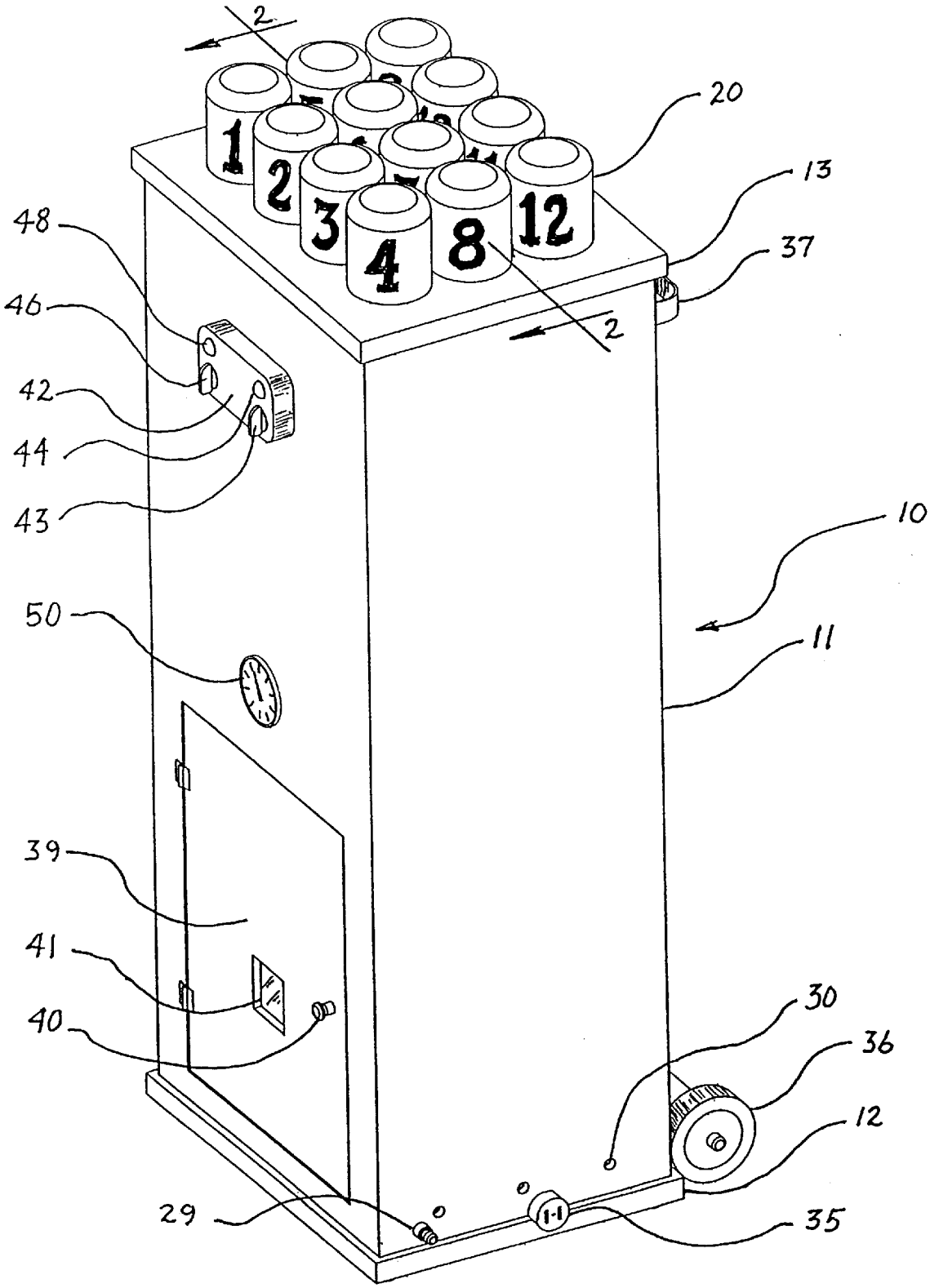
FIG. 1 is a perspective view of the preferred embodiment of the baseball bat warmer constructed in accordance with the principles of the present invention.
Figure 2:
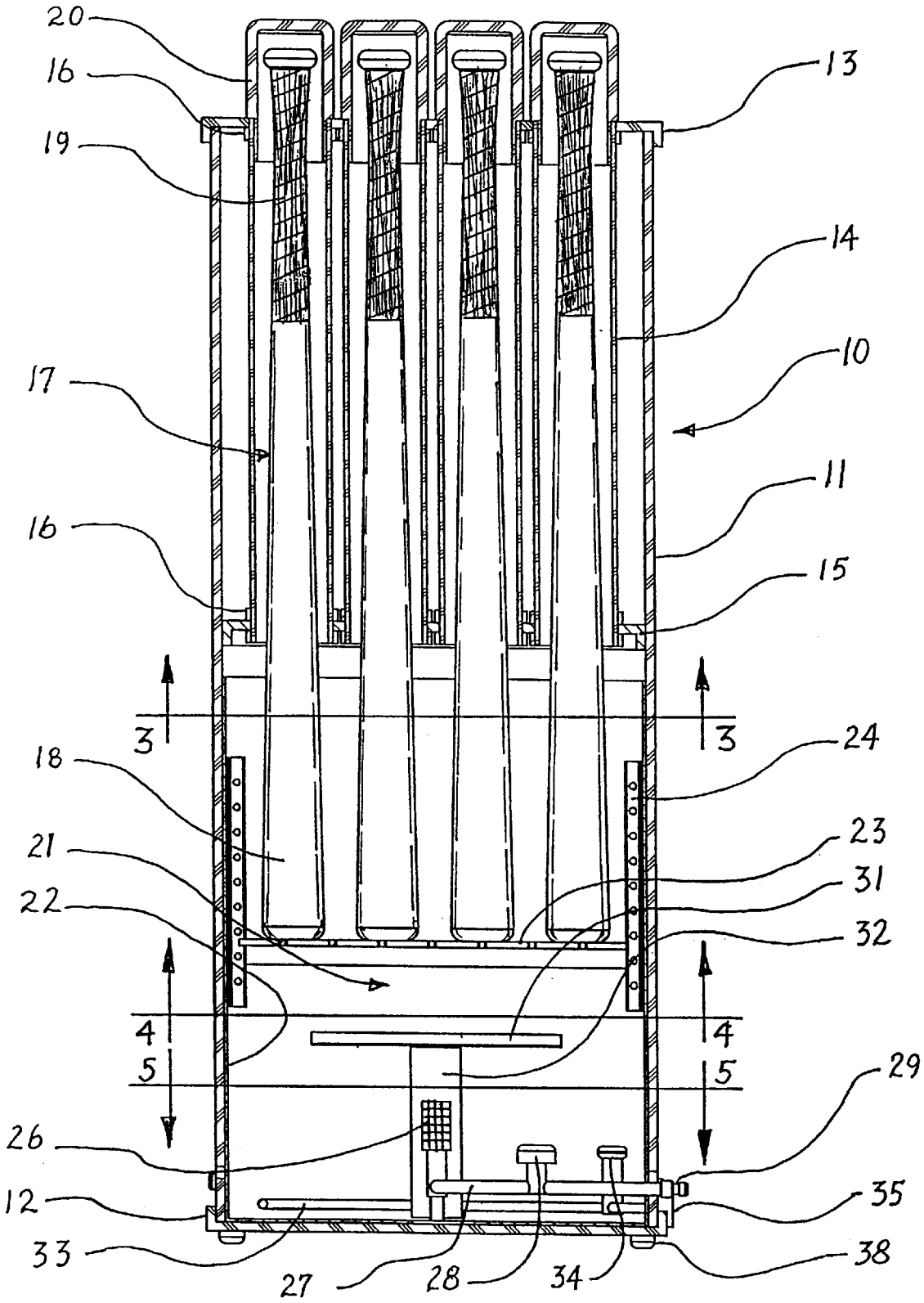
FIG. 2 is a side view in section of the bat warmer taken along line 2—2 in FIG. 1.
Figure 3:
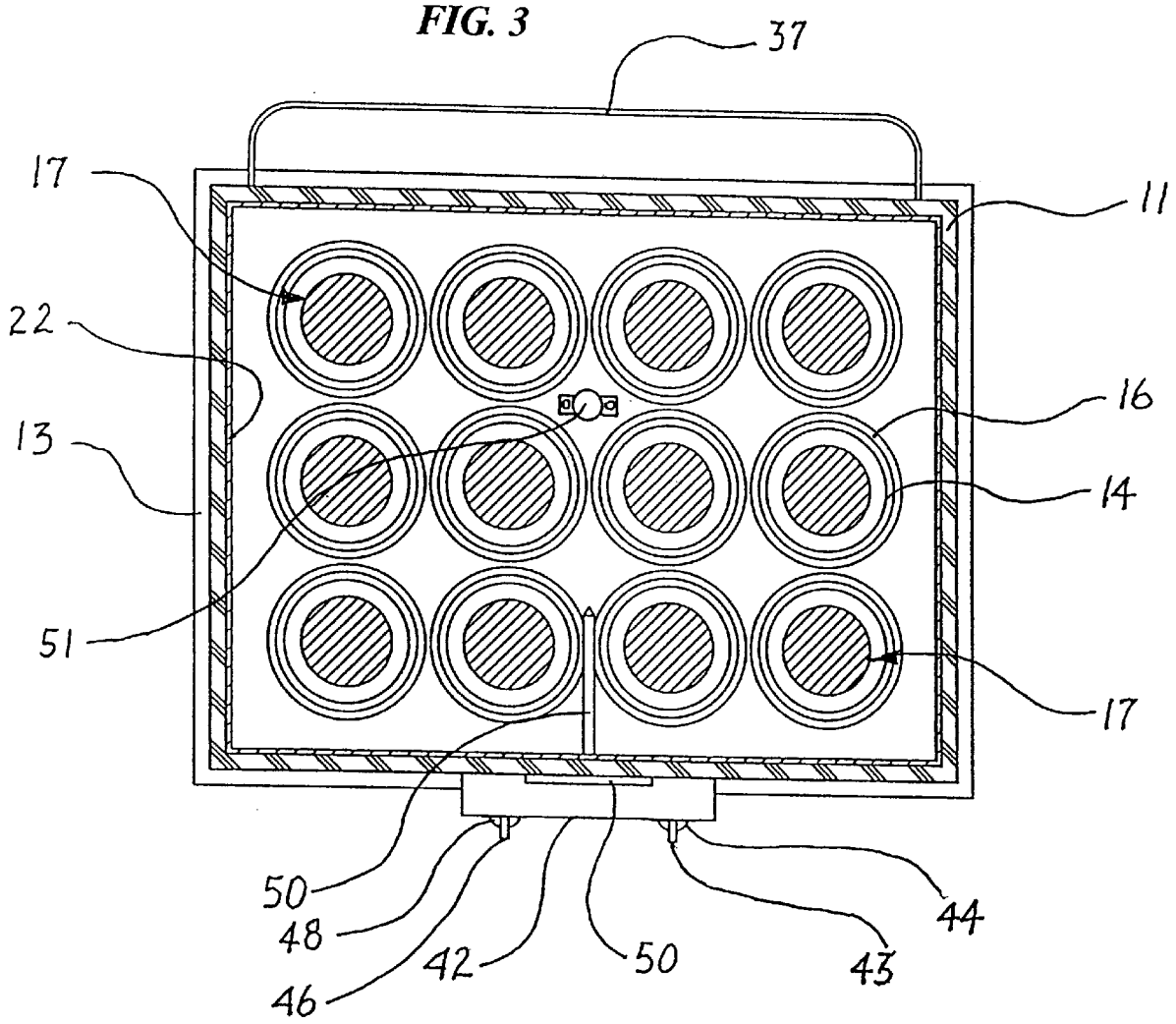
FIG. 3 is a section taken along line 3—3 in FIG. 2 not to scale.
Figure 4:
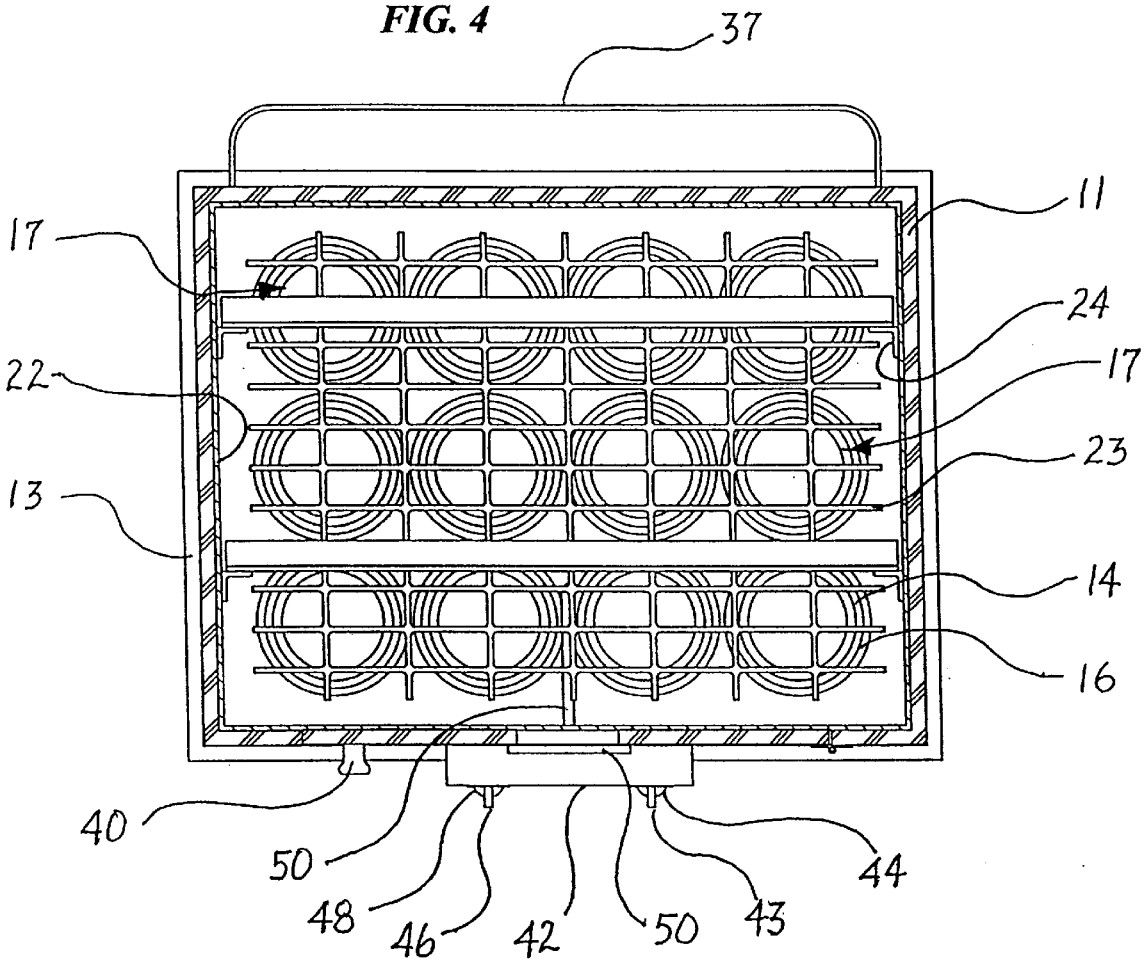
FIG. 4 is a section taken along line 4—4 in FIG. 2 not to scale.
Figure 5:
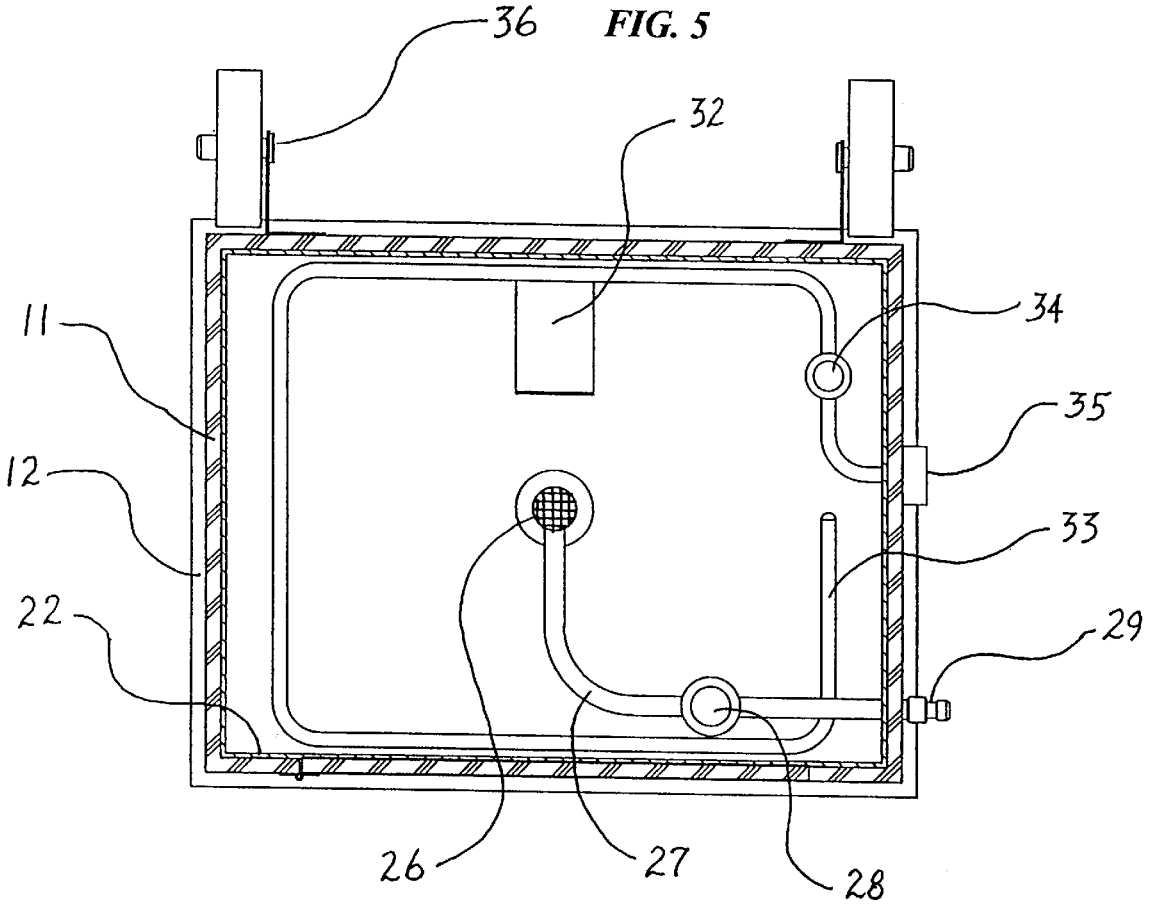
FIG. 5 is a section taken along line 5—5 in FIG. 2 not to scale.
Figure 6:
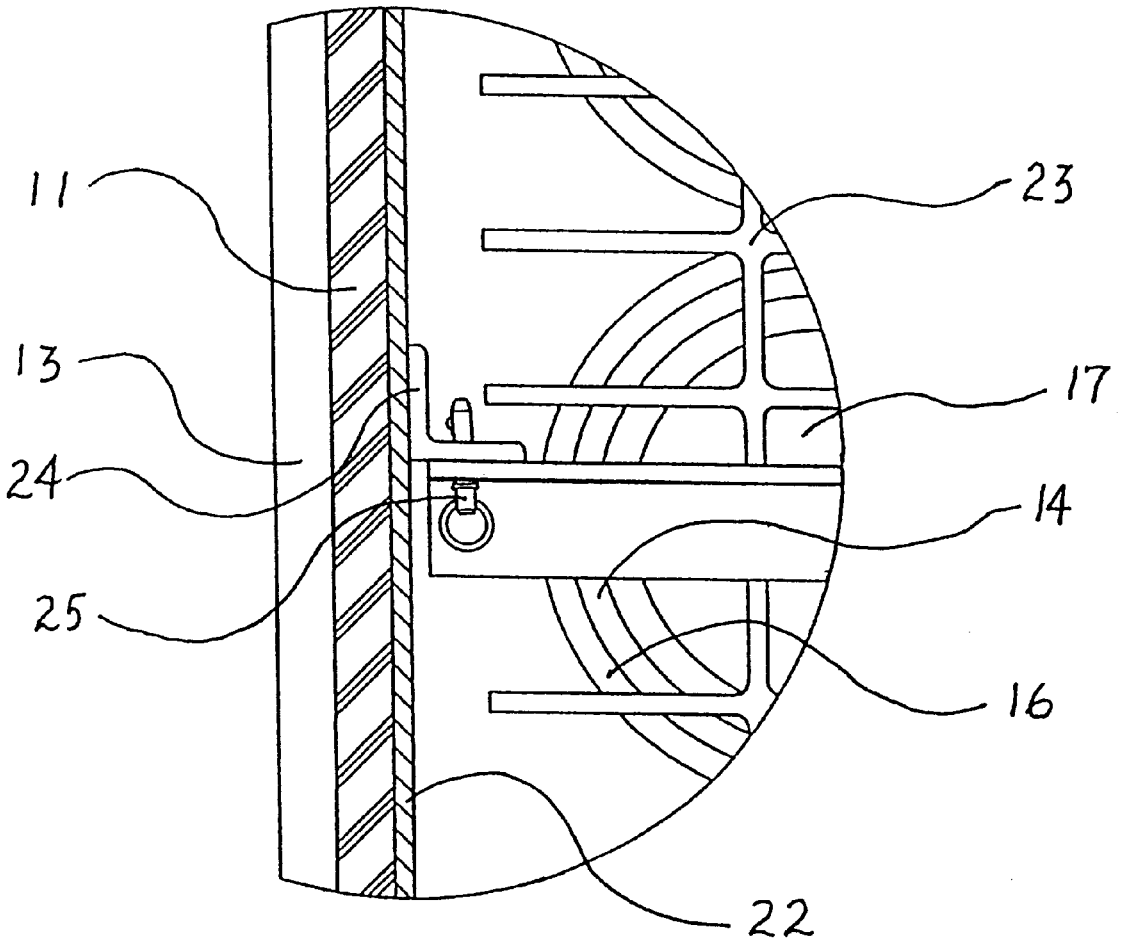
FIG. 6 is a fragmentary sectional view on an enlarged scale illustrating a portion of the showing of FIG. 4.
Figure 7:
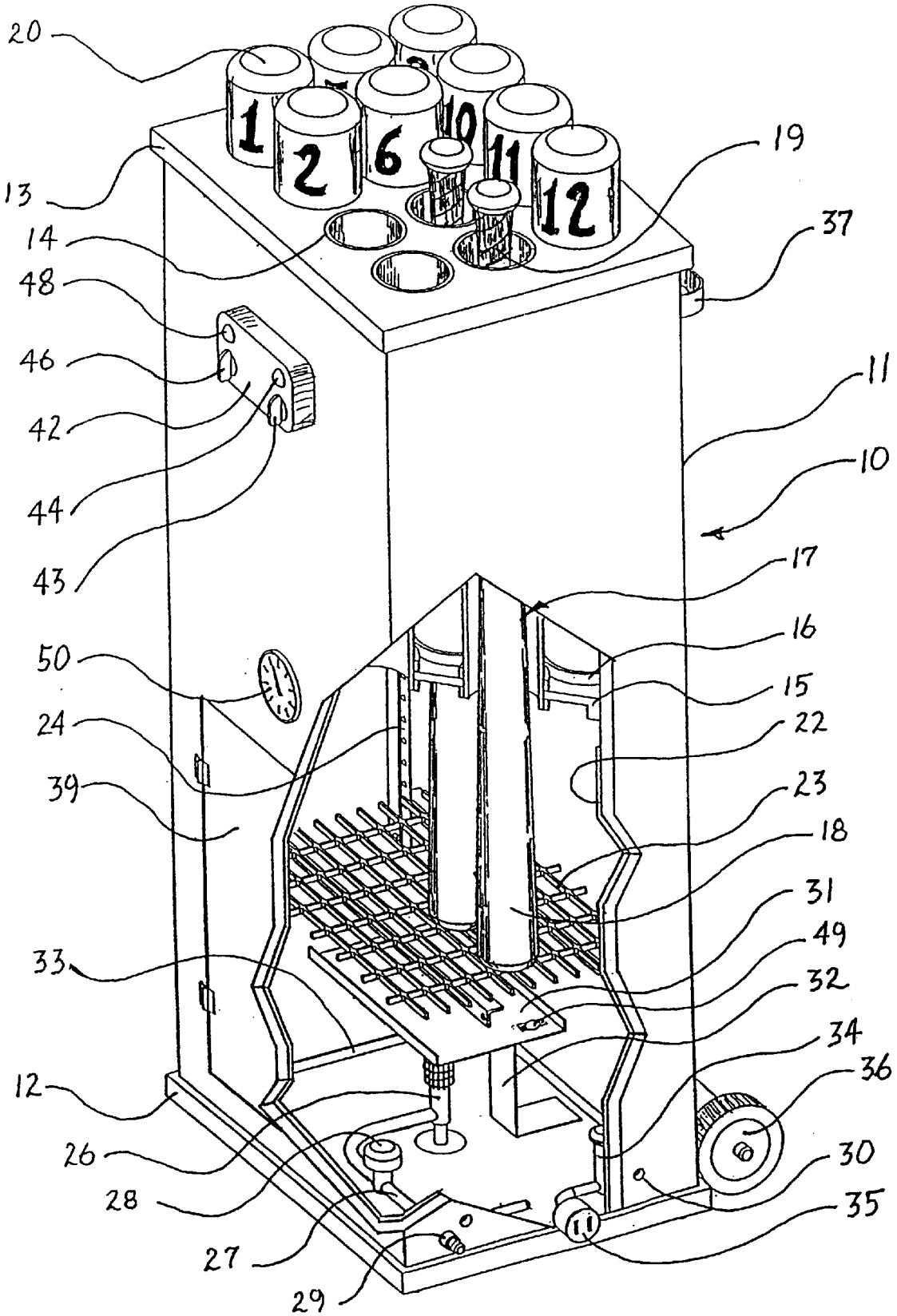
FIG. 7 is a perspective view of the bat warmer, partly broken away and shown in section with three cavity caps removed and with bats positioned in cavities number 7 and 8 only.
Figure 8:
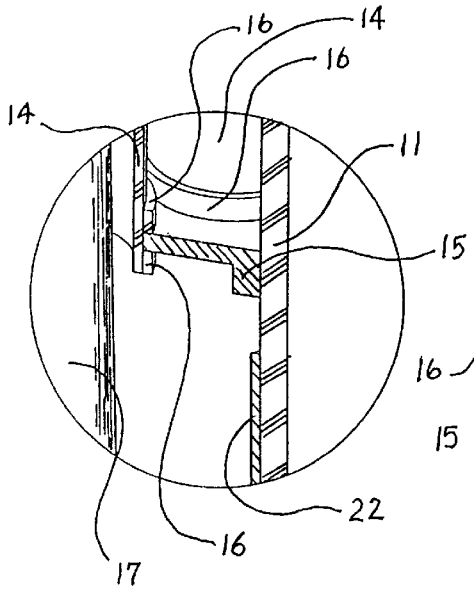
FIG. 8 is a fragmentary view on an enlarged scale based on FIG. 7.
Figure 9:
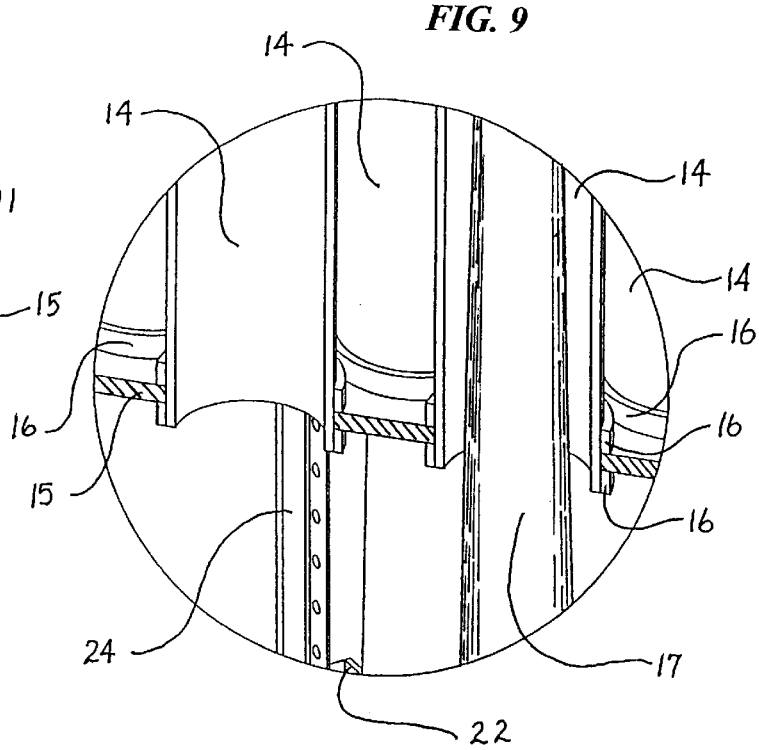
FIG. 9 is an exploded view of FIG. 7.
Figure 10:
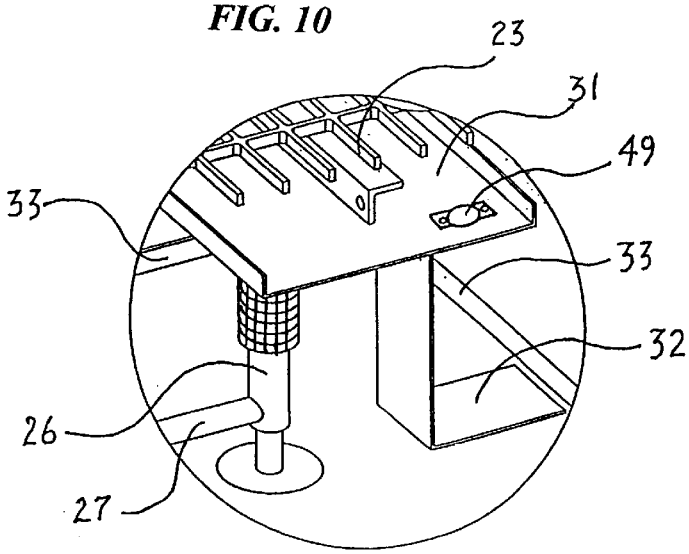
FIG. 10 is an exploded view of FIG. 7.
Figure 11:
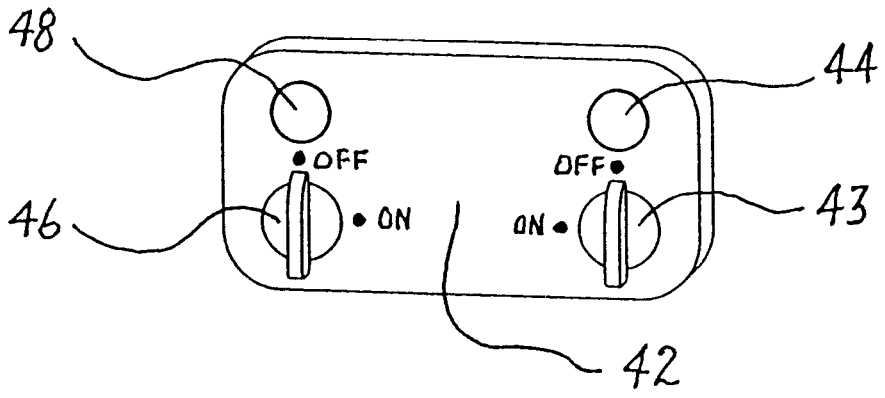
FIG. 11 is a view of the electronic control panel.
Figure 12:
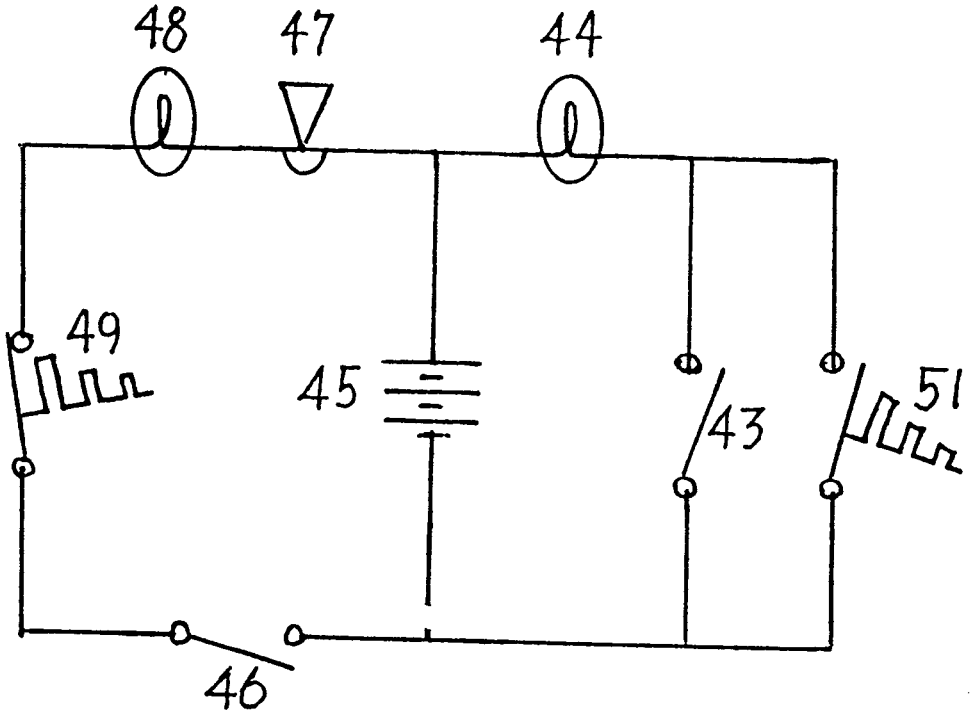
FIG. 12 is a schematic diagram showing the circuitry of the electronic control panel.

With reference now to the drawings, and in particular to FIG. 1 thereof, the preferred embodiment of the new and improved, multi-cavity baseball or softball bat warmer embodying the principles and concepts of the present invention and generally designated by the reference numeral 10 will be discussed.

The present invention, the baseball or softball bat warmer, is comprised of a plurality of components. Such components in their broadest context include an exterior container, a multiple sleeve assembly and a heat chamber. Such components are individually configured and correlated with respect to each other in a vertical position so as to attain the desired objective.

Specifically, the warmer 10 has an elongated exterior wall 11 with a closed bottom 12 and top lid 13 through which are formed a pattern of equal diameter holes. This exterior container is constructed of molded fiberglass. As a substitute for molded fiberglass, any other material or combination of materials could be selected to be used for the container provided it is light weight, rigid and possesses insulating characteristics.

The multiple sleeve assembly consists of parallel, cylindrical tubes 14 of the same length and diameter that pass through and are suspended between the top lid 13 and interior hanger 15 by means of high temperature PVC rings 16 that are glued to the cylindrical tubes. The tubes are made of high temperature PVC. The hanger 15 is fabricated from sheet metal. The cylindrical tubes 14 are sized to accept baseball or softball bats 17.

For proper heating of the bats, the bat barrel 18 is placed in the tube in the down position and the bat handle 19 in the up position. Numbered caps 20, seal the bats in the tube cavities. Another approach for the sleeve assembly would be to form multiple cavities in a block of polystyrene through injection molding. The cavity block would then be positioned above the interior metal hanger.

The heat chamber 21, positioned below the multiple sleeve assembly, is lined with sheet metal 22. A grate 23, used to retain the bats above, is connected to vertical flanges 24 at each end with self-locking pins 25. The flanges have matching, evenly spaced, vertical, hole patterns to provide a means to adjust for the variation in bat lengths available in league play.

The bat warmer is equipped with two heat sources that use convection for warming. The primary heat source uses gaseous fuel and consists of a burner 26, gas line 27, regulator-shut off valve 28 and quick disconnect coupling 29 that would connect to a fuel supply, typically a propane canister. Ventilation holes 30, at the base of the bat warmer permit outside air to enter the heat chamber to support gas combustion. A heat deflection panel 31 connected to a mounting bracket 32 provides uniform heating to the bats above when the gas assembly is used.

An electric assembly consisting of a heating element 33, heating element controller 34 and female receptacle plug 35 is used as a secondary heat source.

In use on a cold day, the bat warmer would be wheeled into the team dugout and placed at a point closest to the batter's warm up circle about thirty minutes before game time using wheel assembly 36 and pull handle 37. Rubber bumpers 38 mounted on the closed bottom 12 protect the exterior finish by providing clearance from the dugout floor. The bats would then be placed in the numbered bat cavities according to the batting line up. The bat retaining grate 23 would have already been positioned to accept the bat lengths used by the team. The gas heating assembly would be selected to warm the bats if the dugout is not equipped with a 120 volt AC electrical outlet.

After connecting the gas supply to quick disconnect coupling 29, access door 39 would be opened using door pull 40, regulator-shut off valve 28 would be opened and burner 26 would be ignited using a lantern lighter. To ensure the lighted burner flame has not been extinguished after the access door is closed, the burner condition would be viewed through boric silicate plate viewing glass 41.

During the bat warmer warm up period, the operational readiness of the electronic control panel 42 would be verified by first checking the DC battery voltage output. This is accomplished by turning switch 43 "on". If warning light 44 illuminates, the battery is considered good. This check also verifies that the warning light will operate in another circuit that indicates when the temperature in the heat chamber is approaching a "too hot" condition. If the warning light does not come "on" when switch 43 in "on", it normally indicates battery 45 should be replaced. With this test complete, switch 43 is turned "off". Next, switch 46 would be turned "on" to verify warning horn 47 located inside electronic panel 42 sounds and warning light 48 comes "on". This check verifies that a separate circuit that monitors the gas supply condition is in working order and completes the operational check of the electronic control panel.

When the bat warmer temperature rises to 145° F., snap action disk thermostat 49 opens, turning off warning horn 47 and warning light 48. By adjusting regulator-shut off valve 28, and viewing the temperature measured by bimetal thermometer probe 50, an optimum heat chamber temperature of 150° F. would be achieved in about fifteen minutes. If the heat chamber temperature exceeds 160° F., snap action disk thermostat 51 mounted on the interior hanger 15 closes and warning light 44 on electron control panel 42 illuminates to identify a "too hot" condition approaching. Sustained heat chamber temperature above 180° F. could cause physical damage to aluminum bats and the multiple sleeve assembly.

In the game, a player would warm up in the batter's circle using a cold bat then retrieve his warmed bat from the bat warmer when it is time to bat. After use, the bat would be returned to the batter's assigned numbered cavity. If the gas burner is extinguished due to a gas supply interruption, the temperature in the heat chamber would begin to drop. When the temperature drops below 135° F., snap action disk thermostat 49 closes causing horn 47 to sound and warning light 48 to illuminate to identify a possible hazardous situation or gas supply depletion.

If the baseball or softball field dugout is equipped with a 120 volt electrical outlet, the electrical heat source would be selected for warming the bats since it would offer a cheaper mode of operation then gas. An extension cord would be run from the outlet in the dugout to female receptacle plug 35 to provide electrical power. Operating temperature would be achieved by adjusting heating element controller 34 and monitoring bimetal thermometer probe 50. The trouble shooting for the operation ofthe electronic panel would be the same as the gas heating assembly with one exception. If after reaching operating temperature horn 47 sounds and warning light 48 came on, it would indicate failure of heating element 33 or a break in the electrical power to the warmer.

In view of the above, it will be seen that the several objects of the invention are achieved and other advantageous results attained. As various changes could be made in the above construction without departing from the scope of the invention, it is intended that all matter contained in the above description or shown in the accompanying drawings shall be interpreted as illustrative and not in a limiting sense.

What is claimed as being new and desired to be protected by Letters Patent of the United States is as follows:

1. A portable warmer for bats such as are used for playing baseball and softball comprising:

an elongated, generally upright container with a bottom panel, sidewalls and a top panel having a series of openings formed therein, said container defining an interior space with an upper portion and a lower portion, a sleeve assembly supported in said upper portion and consisting of a series of parallel tubes that correspond to said series of openings whereby a bat may be inserted through an opening and into the corresponding tube, a heating chamber in said lower portion of said container, a grate supported in said heating chamber below said sleeve assembly to support bats located in said tubes, a heat source to warm the air in said heating chamber and in said tubes to thereby warm said bats and a wheel assembly mounted at the lower end of said container.

2. A portable bat warmer as defined in claim 1 further including a door formed in a sidewall portion of said container to provide access to said heating chamber.

3. A portable bat warmer as defined in claim 1 wherein said grate is vertically adjustable.

4. A portable bat warmer as defined in claim 1, further including caps, each adapted to be placed over an opening to be secured to said top panel so as to cover the opening and prevent escape of warmed air.

5. A portable bat warmer as defined in claim 4 wherein said caps are marked with indicia to provide a systematic means for bat storage and retrieval.

6. A portable bat warmer as defined in claim 1 wherein said sidewalls of said container are provided with thermal insulation to minimize heat loss from said heating chamber.

7. A portable bat warmer as defined in claim 1 wherein said heat source is a fuel burner.

8. A portable bat warmer as defined in claim 7 wherein said fuel is propane.

9. A portable bat warmer as defined in claim 7 wherein said fuel is natural gas.

10. A portable bat warmer as defined in claim 7 wherein said fuel is a solid fuel.

11. A portable bat warmer as defined in claim 1 wherein said heat source is an electrical heating element.

12. A portable bat warmer as defined in claim 11 wherein said heating element has a 120 volt AC current source.

13. A portable bat warmer as defined in claim 11 wherein said heating element has a 12 volt DC current source.

14. A portable bat warmer as defined in claim 1 wherein alternative heat sources are provided including a fuel burner and an electrical heating element.

15. A portable bat warmer as defined in claim 1 including means for regulating said heat source to control the temperature in said heating chamber.

* * * * *